US006061838A

United States Patent [19]

Roffe

[11] Patent Number: 6,061,838

[45] Date of Patent: May 16, 2000

[54] BAG FOR HOLDING A NECKTIE AND ADAPTED FOR USE AS A HANDKERCHIEF

[76] Inventor: Murray S. Roffe, 18 Chestnut Hill Dr., Upper Brookville, N.Y. 11771

[21] Appl. No.: 09/157,988

[22] Filed: Sep. 22, 1998

[51] Int. Cl.[7] ..... A41D 25/00; A41B 15/02

[52] U.S. Cl. ..... 2/279; 2/144

[58] Field of Search ..... 2/144, 279, 207, 2/247; 493/936; 24/3.1; D2/605; 383/72, 76, 4, 127, 75

[56] References Cited

U.S. PATENT DOCUMENTS

| | | | |
|---|---|---|---|
| 906,638 | 12/1908 | Lehman . | |
| 1,980,507 | 11/1934 | Tausik | 41/17 |
| 2,511,242 | 6/1950 | Brown . | |
| 2,578,807 | 12/1951 | Johnson . | |
| 2,803,831 | 8/1957 | Creighton . | |
| 2,909,785 | 10/1959 | Mysels . | |
| 3,093,830 | 6/1963 | Wills . | |
| 3,114,497 | 12/1963 | Kugler | 229/63 |
| 3,206,765 | 9/1965 | Sherman . | |
| 3,260,292 | 7/1966 | Costello | 150/1.7 |
| 4,843,644 | 7/1989 | Sugarman . | |

*Primary Examiner*—John J. Calvert
*Assistant Examiner*—Allissa L. Hoey
*Attorney, Agent, or Firm*—Arthur L. Plevy, Esq.

[57] ABSTRACT

A bag for holding a color-coordinated necktie and for placing in a lapel pocket as a handkerchief is described as having a width of approximately 3.5 inches and a length of 5.5 inches. Drawstring cords are provided for closing and opening the bag. The bag is dimensioned for holding a necktie or a scarf and for placing in a lapel pocket of a jacket, and can be fashioned from silk or polyester material.

15 Claims, 2 Drawing Sheets

BAG FOR HOLDING A NECKTIE AND ADAPTED FOR USE AS A HANDKERCHIEF

BACKGROUND OF THE INVENTION

1. Field of the Invention

This invention relates to neckties and handkerchiefs, and in particular, to a bag for holding a necktie which is adapted for use as a handkerchief in a lapel pocket.

2. Description of Related Art

Certain fashion dictates that a handkerchief be worn in the breast or lapel pocket of a jacket. Handkerchiefs are generally placed in a lapel pocket either in a folded manner, with a straight edge or several diagonal comers showing slightly above the pocket. Handkerchiefs can also be arranged in the pocket in a more random or less formal manner. Recently, men's ties have taken on an entirely new appearance, with bold colors and fabric designs. Thus, in order to be properly dressed, a great variety of handkerchiefs, both in design and fabric, will be necessary to coordinate with jackets or suits, and accompanying shirts and ties.

Prior to this, it has been difficult to find handkerchiefs that perfectly match or color-coordinate with a man's tie. Generally, these items are not available from the tie manufacturer or cannot be purchased together as a unit. Handkerchiefs, which usually must be purchased separately from the necktie, are generally solid colors. Thus, the color of the handkerchief may coordinate with the tie, but does not match the pattern perfectly. For a total fashion look, it is preferable that the handkerchief matches the necktie.

Neckties in the past have been constructed to include additional features other than those traditionally associated with conventional neckties. For example, U.S. Pat. No. 3,206,765 to Sherman relates to a necktie with a money pocket. A pocket is formed in the necktie adjacent an end. The pocket is opened and closed with a zipper, and snap means are provided to maintain the inner folds of the tie. U.S. Pat. No. 4,843,644 to Sugarman relates to a necktie with a bib attached to the inside of the tie. The tie passes through a slot in the bib, and the bib is unfolded and overlies the necktie portion which has been passed through the slot.

Simulated handkerchiefs have been devised which avoid the problem of having to carefully fold a handkerchief prior to placing in a lapel pocket. For example, U.S. Pat. No. 2,803,831 to Creighton relates to an ornamental handkerchief for a man's breast pocket which does not require folding. Color can be changed by a very simple manipulation. Flaps composed of nylon, linen, or silk are individually connected to the inside of the pocket by sewing flaps to the inside of the pocket wall. U.S. Pat. No. 2,909,785 to Mysels relates to a pocket show kerchief. A rectangular body is folded upon itself and is stitched through front and back portions to simulate a folded kerchief appearing above the top of a pocket. U.S. Pat. No. 2,511,242 to Brown relates to a pocket insert in the form of a cloth envelope or flat bag made of different designs which conform to a dress shirt or tie of a desired character. The pocket insert formed of two opposite cloth sections contains a stiffener or sheet of flexible material which causes the pocket to be retained in a flat condition. An elastic band at the open end retains the form in position and constantly urges the stiffening member against the closed end.

Combining neckties with other articles has been described in several patents. U.S. Pat. No. 3,093,830 to Wills relates to a reversible combination tie-vest article. The tie-vest is of unitary construction having a unitary vest panel with a portion extending from the top to provide a neck tie band. U.S. Pat. No. 2,578,807 to Johnson relates to a combination necktie and pocket handkerchief which the wearer can detach from the necktie and insert into a breast pocket of a jacket. The handkerchief consists of an end piece of the necktie attached by snap fastener means. The end piece is stitched around a stiffening frame such as wire to maintain the shape of the simulated handkerchief. When the user desires to wear the handkerchief, the end piece is removed from the tie, inverted, and placed in a pocket.

There remains a need for a color-coordinated or matching tie and handkerchief combination which is readily obtainable and easy to use for an overall fashionable appearance, while avoiding the difficulties in matching separate handkerchiefs to the myriad of fabric patterns and colors of neckties.

SUMMARY OF THE INVENTION

Briefly described, the invention comprises a bag for holding a necktie and for placing in a lapel pocket as a handkerchief. The bag is formed of cloth, such as silk or polyester, and is a substantially flat and rectangular. Drawstring means at the open end of the bag for closing and opening the end are provided. The bag is approximately 5.5 inches in length and 3.5 inches in width, being dimensioned for holding a necktie, either rolled or folded, and can be placed in a lapel pocket when the tie is removed from the bag.

These and other features of the invention will be more fully understood by reference to the following drawings.

DETAILED DESCRIPTION OF THE INVENTION

During the course of this description, like numbers will be used to identify like elements according to the different views that illustrate the invention.

Figure 1:
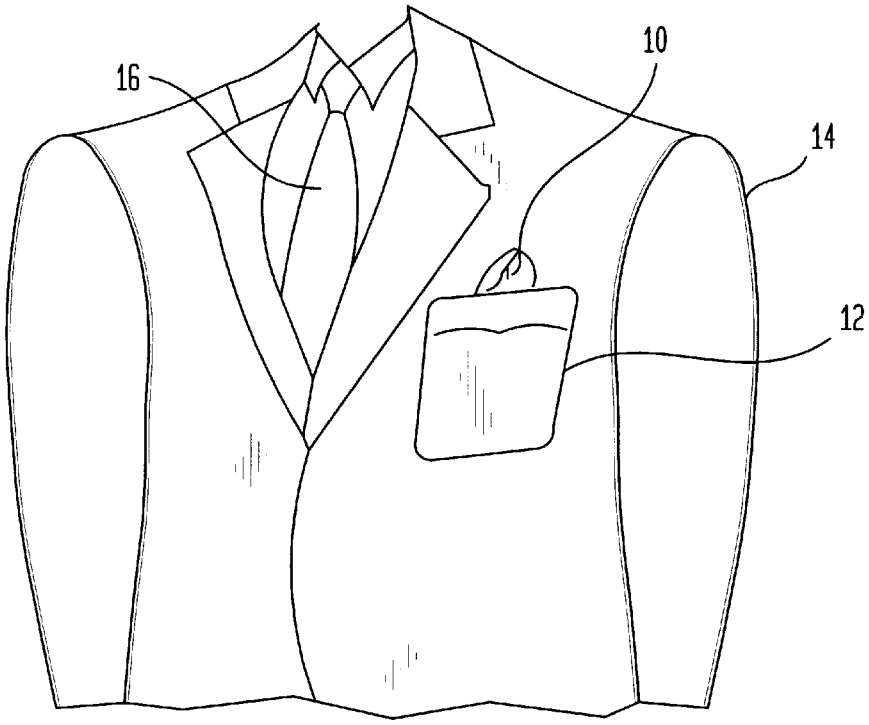
FIG. 1 is a view of the bag shown in context in the lapel pocket of a jacket

As illustrated in FIG. 1, the bag 10 according to the preferred embodiment of the invention is seen in context. The bag 10 is shown in the breast pocket 12 of a jacket 14. A tie 16 is shown which coordinates with the bag 10. When placed in the pocket 12, the bag 10 functions as a handkerchief. The tie 16 and bag 10 can either have perfectly matched patterns and colors, or the tie 16 can fabricated from a color-coordinated material, so that when the tie 16 is worn to complement the man's suit, the bag 10 is used as a handkerchief to color-coordinate and complete the combination.

Figure 2:
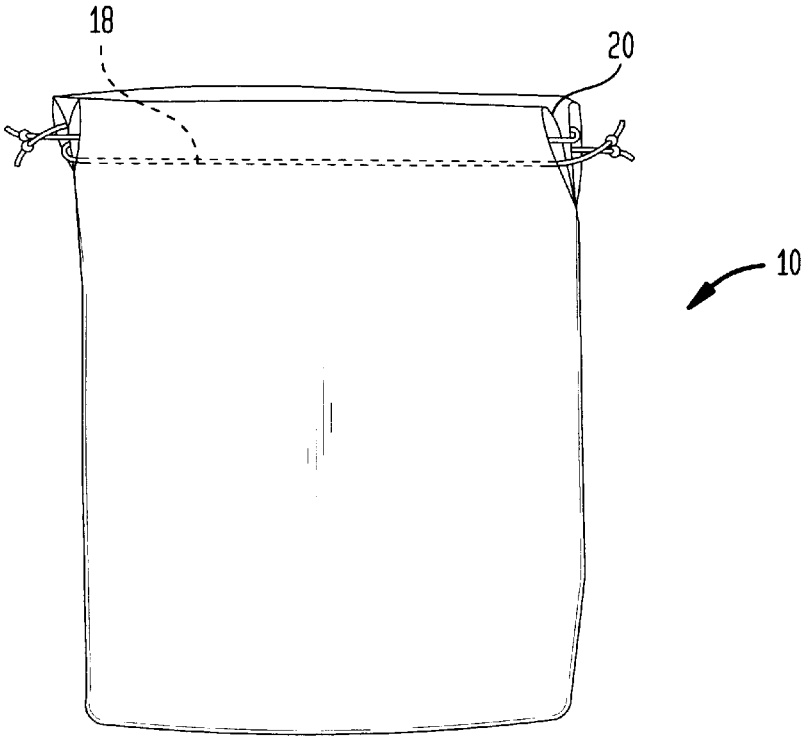
FIG. 2 is a perspective view of the bag.

FIG. 2 shows a perspective view of the bag 10. The bag 10 is formed of cloth, preferably silk or polyester, or other common materials used in making neckties or scarves. Bag 10 is dimensioned to hold a rolled up or folded tie or scarf 16. Formed from an elongated rectangular piece of cloth having a length of approximately 12 inches and a width of approximately 4 inches, the bag 10 is made by folding approximately 0.5 inches of each end of the elongated fabric over and stitching a seam 18, thus forming a loop 20 on each end of the fabric.

Figure 3:
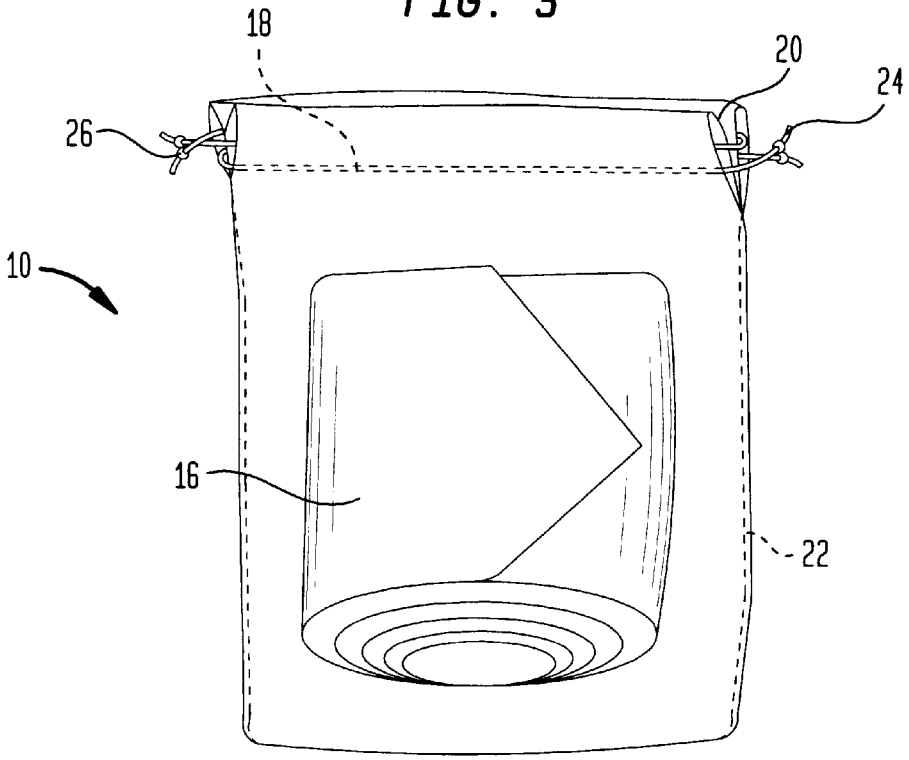
FIG. 3 is a view of the bag in phantom showing a tie or scarf rolled up inside.

FIG. 3 shows the bag 10 in phantom with a man's tie or women's scarf 16 rolled up and inserted into the bag 10. After forming the loops 20 as described above, the fabric is folded in half, leaving the unfinished side of the fabric exposed, and stitched along the length of each side, thus forming a scam 22 of approximately 0.25 inches along both sides, while leaving a clearance of approximately one inch from the open end of the bag 10. The bag 10 is then inverted to expose the finished side of the fabric. Two pieces of cording 24 and 26, each having a length of approximately 15 inches, are passed through the loops 20 and tied on opposite sides of the bag 10. The bag 10 thus formed is essentially a drawstring pouch. In its completed state, the bag 10 has a width of approximately 3.5 inches and a length of approximately 5.5 inches. Pulling on each tied cord 24 and 26 closes the bag 10 which is easily opened by inserting fingers in the closed end and pulling the cloth apart. Preferably the cording employed is smooth, so it easily opens and closes the bag 10.

Figure 4:
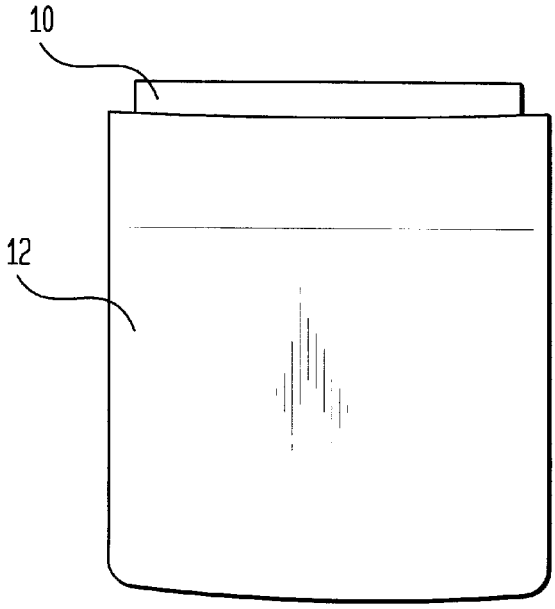
FIG. 4 is an alternative placement of the bag in the lapel pocket of a jacket.

FIG. 4 shows an alternative placement of the bag 10 in a lapel pocket. As shown, the bag 10 is laid flat to show a straight edged portion of the bag 10. Since the width and the length of the bag is dimensioned to fit into a lapel pocket, the bottom of the bag extends from the bottom of the pocket to expose a straight edge portion of the bag 10. Of course, other alternative placements of the bag 10 are possible, limited only by what fashion dictates.

In addition to avoiding the problem of trying to match a handkerchief to a tie, the bag 10 and tie 16 combination is also useful when traveling, as the tie 16 can be compactly kept within the bag.

While the invention has been described with reference to the preferred embodiment thereof, it will be appreciated by those of ordinary skill in the art that modifications can be made to the parts that comprises the invention without departing from the spirit and scope thereof.

What is claimed is:

1. A combination necktie and bag comprising:

a necktie; and a substantially flat rectangular cloth bag having a length of approximately 5.5 inches and a width of approximately 3.5 inches, said bag having an open end;

drawstring means for closing and opening said open end, wherein said bag is dimensioned for holding the necktie and for placing in a lapel pocket as a handkerchief when the necktie is removed from the bag, the bag and necktie having coordinate colors.

2. The combination necktie and bag of claim 1, wherein said bag is formed of silk.

3. The combination necktie and bag of claim 2, wherein said bag and said necktie are formed from identically patterned cloth.

4. The combination necktie and bag of claim 1, wherein said bag is formed of polyester.

5. The combination necktie and bag of claim 4, wherein said bag and said necktie are formed from identically patterned cloth.

6. A combination scarf and bag comprising:

a scarf, and a substantially flat rectangular cloth bag having a length of approximately 5.5 inches and a width of approximately 3.5 inches, said bag having an open end;

drawstring means for closing and opening said open end, wherein said bag is dimensioned for holding the scarf and for placing in a lapel pocket as a handkerchief when the scarf is removed from the bag, the bag and scarf having coordinate colors.

7. The bag of claim 6, wherein said combination scarf and bag is formed of silk.

8. The bag of claim 7, wherein said combination scarf and bag and said scarf are formed from identically patterned cloth.

9. The bag of claim 6, wherein said combination scarf and bag is formed of polyester.

10. The bag of claim 9, wherein said combination scarf and bag and said scarf are formed from identically patterned cloth.

11. A color-coordinated bag and necktie kit, the kit comprising the combination of:

a necktie; and a rectangular cloth bag having a length of approximately 5.5 inches and a width of approximately 3.5 inches, said bag having an open end;

drawstring means for closing and opening said open end, wherein said bag is dimensioned for holding the necktie and adapted to fit in a lapel pocket as a handkerchief when the necktie is removed from the bag.

12. The bag of claim 11, wherein said kit is formed of silk.

13. The bag of claim 12, wherein said kit and said necktie are formed from identically patterned cloth.

14. The bag of claim 11, wherein said kit is formed of polyester.

15. The bag of claim 14, wherein said kit and said necktie are formed from identically patterned cloth.

* * * * *